US006763536B2

(12) United States Patent
Dewert

(10) Patent No.: US 6,763,536 B2
(45) Date of Patent: Jul. 20, 2004

(54) MOTOR ADJUSTABLE SUPPORT DEVICE FOR THE UPHOLSTERY OF A PIECE OF FURNITURE THAT IS USED FOR SITTING AND/OR LAYING UPON

(75) Inventor: Eckhart Dewert, Zürich (CH)

(73) Assignee: Cimosys AG, Goldingen (CH)

( * ) Notice: Subject to any disclaimer, the term of this patent is extended or adjusted under 35 U.S.C. 154(b) by 0 days.

(21) Appl. No.: 10/268,976

(22) Filed: Oct. 11, 2002

(65) Prior Publication Data

US 2003/0079290 A1 May 1, 2003

Related U.S. Application Data

(63) Continuation of application No. PCT/EP01/04094, filed on Apr. 10, 2001.

(30) Foreign Application Priority Data

Apr. 11, 2000 (DE) ..... 200 06 690 U

(51) Int. Cl.[7] ..... A61G 7/015; A61G 7/018
(52) U.S. Cl. ..... 5/618; 5/616; 5/617
(58) Field of Search ..... 5/618, 617, 616, 5/613, 236.1, 722

(56) References Cited

U.S. PATENT DOCUMENTS

| | | | | |
|---|---|---|---|---|
| 3,051,965 A | | 9/1962 | Szemplak et al. | 5/616 |
| 3,300,794 A | | 1/1967 | Altorfer | 5/616 |
| 3,447,170 A | | 6/1969 | Spitz | 5/722 |
| 3,717,376 A | | 2/1973 | Lutchansky | 5/236.1 X |
| 4,258,445 A | | 3/1981 | Zur | 5/614 |
| 4,336,621 A | | 6/1982 | Schwartz | 5/722 |
| 4,349,924 A | | 9/1982 | Zur | 5/618 |
| 4,381,571 A | * | 5/1983 | Elliott | 5/616 |
| 4,463,463 A | | 8/1984 | Kaneko | 5/616 |
| 4,559,656 A | | 12/1985 | Foster | 5/236.1 |
| 4,589,151 A | | 5/1986 | Behrens | 5/236.1 X |

(List continued on next page.)

FOREIGN PATENT DOCUMENTS

| | | |
|---|---|---|
| CH | 607 682 | 10/1978 |
| DE | 31 03922 A1 | 8/1982 |
| DE | 32 182 78 A1 | 11/1983 |
| DE | 87 11 567.0 | 3/1988 |
| DE | 88 00 360.4 | 7/1988 |
| DE | 88 06 094.2 | 8/1988 |
| DE | 38 42 078 A1 | 7/1989 |
| DE | 38 42 078 C2 | 7/1992 |
| DE | 93 11 520 U1 | 6/1994 |

(List continued on next page.)

OTHER PUBLICATIONS

International Search Report, (English version) dated Sep. 26, 2001 for PCT/EP01/04094, filed Oct. 4, 2001, 2 pages.
Catalogue of the German firm Dewert Antriebs–und Systemtechnik "Gesamtprogramm 1995/96" pp. 12 & 13.

(List continued on next page.)

*Primary Examiner*—Robert G. Santos
(74) *Attorney, Agent, or Firm*—Shlesinger, Arkwright & Garvey LLP

(57) ABSTRACT

Support device can be adjusted by use of a motor and is used for the upholstery of a piece of furniture for sitting and/or laying upon, such as a mattress of a bed. A base may be provided with at least two relatively adjustable support components. The support device may have at least one drive unit detachably connected to the base and provided with a housing having a recess. A rotatably mounted shaft engages with the recess when the drive unit is assembled. The shaft engages with a support component to be adjusted and can be rotated by the drive unit. The drive unit is placed on the shaft from the support side so that the housing of the drive unit is arranged between the support components and the shaft. Thus, the support device has a lower profile than conventional support devices.

33 Claims, 5 Drawing Sheets

U.S. PATENT DOCUMENTS

| | | | | | |
|---|---|---|---|---|---|
| 4,800,599 | A | * | 1/1989 | Korchinski et al. | 5/618 |
| 4,928,332 | A | | 5/1990 | Ogden et al. | 5/614 |
| 5,063,623 | A | | 11/1991 | Bathrick et al. | 5/616 |
| 5,317,769 | A | | 6/1994 | Weismiller et al. | 5/610 |
| 5,490,298 | A | * | 2/1996 | Goldsmith et al. | 5/611 |
| 5,491,854 | A | | 2/1996 | Music | 5/618 |
| 5,537,701 | A | | 7/1996 | Elliott | 5/618 X |
| 5,542,744 | A | | 8/1996 | Bathrick | 297/362.11 |
| 5,544,376 | A | | 8/1996 | Fromson | 5/618 |
| 5,577,280 | A | | 11/1996 | Elliott | 5/618 |
| 5,640,730 | A | | 6/1997 | Godette | 5/618 |
| 5,675,849 | A | | 10/1997 | Koch | 5/616 |
| 5,687,437 | A | * | 11/1997 | Goldsmith | 5/611 |
| 5,740,568 | A | * | 4/1998 | Elliott | 5/620 |
| 5,870,784 | A | | 2/1999 | Elliott | 5/618 |
| 5,916,086 | A | | 6/1999 | Rossdeutscher | 5/236.1 |
| 5,926,872 | A | | 7/1999 | Rossdeutscher | 5/236.1 |
| 5,926,877 | A | | 7/1999 | Lin | 5/618 |
| 6,006,379 | A | | 12/1999 | Hensley | 5/618 |
| 6,061,852 | A | | 5/2000 | Bathrick et al. | 5/618 |
| 6,079,065 | A | | 6/2000 | Luff et al. | 5/618 |
| 6,088,853 | A | | 7/2000 | Jansen | 5/618 |
| 6,101,647 | A | | 8/2000 | Stroud et al. | 5/618 |
| 6,105,187 | A | | 8/2000 | Gnjatovic | 5/618 |
| 6,209,157 | B1 | * | 4/2001 | Hensley | 5/618 |
| 6,269,707 | B1 | | 8/2001 | Koch | 74/89.23 |
| 6,311,348 | B1 | | 11/2001 | Luff et al. | 5/618 |
| 6,393,641 | B1 | * | 5/2002 | Hensley | 5/618 |
| 6,679,555 | B2 | * | 1/2004 | Bangert | 297/316 |
| 6,687,932 | B1 | * | 2/2004 | Bangert et al. | 5/617 |
| 2001/0000828 | A1 | | 5/2001 | Hensley | 5/618 |
| 2002/0152552 | A1 | | 10/2002 | Dewert | 5/618 |
| 2002/0162170 | A1 | * | 11/2002 | Dewert | 5/617 |
| 2003/0079290 | A1 | * | 5/2003 | Dewert | 5/618 |
| 2003/0106154 | A1 | * | 6/2003 | Takeuchi | 5/618 |
| 2003/0208845 | A1 | * | 11/2003 | Heaton | 5/618 |
| 2004/0034934 | A1 | * | 2/2004 | Weinman et al. | 5/618 |

FOREIGN PATENT DOCUMENTS

| | | | |
|---|---|---|---|
| DE | 195 00 185 | A1 | 7/1996 |
| DE | 195 03 650 | A1 | 8/1996 |
| DE | 195 42 321 | A1 | 5/1997 |
| DE | 297 01 084 | U1 | 7/1997 |
| DE | 197 39 453 | A1 | 3/1999 |
| DE | 695 07 158 | T2 | 9/1999 |
| DE | 299 07 850 | U1 | 10/1999 |
| DE | 200 00 700 | U1 | 5/2000 |
| EP | 0 373 912 | | 6/1990 |
| EP | 0 372 032 | B1 | 5/1992 |
| EP | 0 372 032 | | 5/1992 |
| EP | 0 568 957 | A1 | 11/1993 |
| EP | 0 583 660 | A1 | 2/1994 |
| EP | 0 583 660 | A1 | 3/1994 |
| EP | 0 721 754 | A1 | 7/1996 |
| EP | 0 873 709 | A1 | 10/1998 |
| EP | 0 884 011 | A1 | 12/1998 |
| EP | 0 935 937 | A1 | 8/1999 |
| FR | 2 780 256 | A1 | 12/1999 |
| WO | 91/01099 | | 2/1991 |
| WO | 92/09520 | | 6/1992 |
| WO | 96/29970 | | 10/1996 |
| WO | 99/42021 | | 8/1999 |

OTHER PUBLICATIONS

Catalogue of the German firm Dewert Antriebs–und Systemtechnik "Antriebe, Handschalter, Steuerungen, Beschläge", No. 05/97 (excerpt 6 pages).

International Preliminary Examination Report (PCT) Article 36 & Rule (70), dated Apr. 30, 2002 for International Application No. PCT/EP00/13804 (4 pgs).

International Search report for International Application No. PCT/EP00/13084 dated Jun. 15, 2001 (4 pgs).

PCT Schriftlicher Bescheid (Regel 66 PCT) dated Nov. 14, 2001 (6 pgs).

* cited by examiner

MOTOR ADJUSTABLE SUPPORT DEVICE FOR THE UPHOLSTERY OF A PIECE OF FURNITURE THAT IS USED FOR SITTING AND/OR LAYING UPON

CROSS REFERENCE TO RELATED APPLICATIONS

This application is a continuation of application Ser. No. PCT/EP01/04094, filed Apr. 10, 2001, which claims priority of German Application No. 200 06 690.0, filed Apr. 11, 2000, and each of which is incorporated herein by reference.

FIELD OF THE INVENTION

The invention relates to an adjustable support device for the upholstery of a piece of furniture that is used for sitting and/or laying upon. More particularly, the invention relates to a motor adjustable support device for adjusting the configuration of the mattress of a bed.

BACKGROUND OF THE INVENTION

Such support devices are generally known in the form of motor adjustable slats for beds and such.

A related motor adjustable support device of this type is known from DE 38 42 078 C2 in the form of a slat system that is provided with a base body with a frame, to which several adjustable support components are connected in relation to one another. The known support device has a drive unit with a housing that is connected to the base body and can be removed. The housing has two recesses offset from one another, into which in the assembly position of the drive unit one shaft each, each of which is rotatably mounted to the base body of the support device, engages with an adjustable support component; and the adjustable support can be rotated by means of the drive unit. In the known support device, the drive unit is arranged below the slat frame.

One disadvantage of the known support device is that it has a relatively large height.

Similar support devices are also known from EP 0 372 032 B1, and EP 0 583 660 B1. These support devices also have a relatively large height.

OBJECTS AND SUMMARY OF THE INVENTION

The invention is based on the task of providing a motor adjustable support device for a piece of reclining furniture that does not have the disadvantage of known support devices; namely, the height of the adjustable support device is reduced.

This object is achieved by the motor adjustable support device for a piece of reclining furniture according to the invention including: a base; at least two support components provided on the base and defining a support side of the support device, the at least two support components being adjustable relative to each other; at least one detachable drive unit detachably connected to the base; a drive housing provided for the at least one drive unit; at least one recess provided in the drive housing; a rotatable shaft provided for adjusting the at least two support components relative to each other; at least one of the rotatable shaft and a drive of the at least one drive unit extending through the at least one recess for engaging with the other one of the at least one rotatable shaft and the drive of the at least one drive unit; the at least one detachable drive unit being provided in the drive housing for causing the drive to engage the rotatable shaft by placing the at least one detachable drive unit onto the rotatable shaft from the support side, the at least one drive unit thereby adjusting the at least two support components relative to each other when the at least one drive unit is driven; and the at least one drive unit being disposed substantially between the at least two support components and the rotatable shaft.

The invention departs from the concept of arranging the drive unit below the base body of the support device, as is the case in known support devices. The invention is rather further based on the idea of arranging the drive unit in such a way that it is arranged in a vertical direction in its assembly position between the shaft and the support components. For this purpose the invention includes that the drive unit is placed onto the shaft from the support side.

In this way, the drive unit is received between the shaft and the support components so that it does not, or only insignificantly protrudes over the base body of the support device. The height of the inventive support device is therefore substantially reduced, and is essentially determined by the height of the base body of the support device.

Owing to the low height of the support device, a space formed below the support device at the assembly position of the support device, such as on a bed, can be utilized, such as for the storage of objects, as this space is not filled, or is only insignificantly filled by the drive unit.

Furthermore, the inventive support device is visually attractive, as it essentially gives the appearance of a conventional, non-motor adjustable support device owing to its low height.

A further advantage of the inventive support device is that due to its low height, it uses less space during transport and during storage than known support devices. This represents a cost savings.

The inventive support device can be produced simply and at low cost, and can be easily attached to the base body of the support device.

A further embodiment of the inventive teaching includes the feature that the shaft is supported on the base body of the support device. This results in a stable and robust construction.

Another embodiment of the inventive teaching intends that a pivot lever is nonrotatably connected to the shaft, which is rotatably mounted to the drive unit by means of a drive motor for rotating the pivot lever. In this way, the adjusting device of the inventive support device is of particular simple construction, and can therefore be produced at low cost. Furthermore, in this embodiment, extremely high forces can be exerted by the adjusting device, which is particularly of advantage when the support device is to be adjusted under a load, such as under the weight of the person resting on it.

The drive unit of the inventive support device can be constructed in any suitable way. An advantageous embodiment includes that the drive unit has a linearly movable drive element which engages with a rotation lever for rotating the same. In this way, a simple and low cost, as well as robust construction of the drive unit is achieved.

In the embodiment with the rotation lever, the rotation lever is may be an angled or bent lever, as a further embodiment teaches. Given a corresponding linkage to the lever, such as with a linearly movable drive element, particularly high forces can be exerted in this embodiment.

In the embodiment with the linearly movable drive element, it can be constructed in any suitable way. A further embodiment includes the feature that the linear movable drive element is a spindle nut which is nonrotatably and in axial direction displaceably held on a rotatable non-displaceable spindle. Such spindle drives are available as simple and low cost, as well as robust standard components.

In a kinematic reverse of the previously mentioned embodiment, the linearly movable drive element, however, can also be a fixed spindle movable in its axial direction, on which a locally fixed, rotatable spindle nut is arranged.

It is generally sufficient that the support device has a single shaft which engages with the support component to be adjusted. Purposefully, however, two rotatable shafts may be included, whereby a recess in the housing of the drive unit is assigned to each shaft. By using two shafts, of which each engages with at least one support component to be adjusted, multiple adjustment possibilities can be achieved. For instance in the case of a slat system that has an upper body support component, a head support component, a leg support component, and a lower leg support component, which can be adjusted in relation to a center support component.

A further advantageous embodiment of the inventive teaching includes a locking means for the locking of the drive unit in an assembly position on the support device. This prevents the drive units from separating from the shaft under load.

Purposefully, the base body of the inventive support device has a frame, such as a further embodiment includes.

A further embodiment of the inventive teaching includes that the support device is constructed as a slat system.

An extraordinarily advantageous improvement of the inventive teaching includes the feature that the drive unit is arranged on a first part of the furniture, that the drive unit has a winding device for a band, rope, strand-like, or chain-like pulling element, that the strand-like pulling element is fed across at least one first pulley-like turn roller, the at least one first pulley-like turn roller being connected to a part which is fixed during adjustment of at least one of the at least two support components, the strand-like pulley element is fed across at least one second pulley like turn roller which is connected to one of the two support components, and that the strand-like pulley element cooperates with said first and second pulley-like turn rollers to define a pulley block. In this embodiment, the inventive furniture drive of the inventive support device works like a pulley-block. Because of this, high forces can be exerted by the drive unit of the furniture drive even with the use of smaller, and therefore less expensive adjustment motors, such as electric motors. By using smaller, and therefore less expensive drive motors, the inventive furniture drive is simple as a whole, and thereby low in cost. Its construction is also compact.

It generally suffices if the pull element is fed across the turn rollers like a 2-rope pulley. An extraordinarily advantageous embodiment of the inventive teaching includes, however, that first and second pulley-like turn rollers define an at least 4-pulley system. This embodiment achieves a higher reduction than with merely a 2-pulley system so that especially high forces can be exerted depending on the amount of ropes or pulleys of the pulley of the pulley system. The drive motor of the drive unit can therefore be constructed even smaller and lower in cost, and is also more compact.

Further improvements of the inventive teaching include that the turn rollers assigned to a drive unit, and that are arranged on the housing or on another locally fixed part during the adjustment of the support component, have coaxial pivot axes, or the turn rollers are arranged on a mutual pivot axis, and/or that the turn rollers are assigned to the support component, and that the turn rollers are arranged on it or on an intermediate part and have coaxial pivot axes, or are arranged on a mutual pivot axis. In this embodiment, the turn rollers which are assigned to a part of the furniture each form a compact, space saving roller block.

Other improvements according the invention include that the turn rollers are assigned to a drive unit, and are arranged on the housing or on another locally fixed part during the adjustment of the support component and have pivot axes which are parallel to each other, and/or that the turn rollers are assigned to the support component, and are arranged on the support component or on an intermediate part and have pivot axes which are parallel to each other. These embodiments result in a particularly compact construction in an axial direction of the turn rollers.

According to the respective requirements, an end of the pull means opposite to the winding device can be attached on the support component to be adjusted, or on an intermediate part which engages with the support component for the adjustment of the same, or on the housing, or on the first part.

Any desirable adjustment movements of parts of a furniture can generally be performed with the inventive furniture drive. Purposefully, the drive unit, or the drive units, are constructed as a rotation drive, or as rotation drives, respectively, for the rotation of the support component, or for the rotation of the support components, respectively, in relation to the first part, as is included in an embodiment according to the invention. This embodiment is particularly simple, and therefore low cost in its construction, as a rotation drive according to the pulley principle can be realized low construction expenses.

A further improvement according to the inventive teaching includes that an intermediate part is a rotation lever which carries at least one turn roller. This embodiment is simple in its construction, and can therefore be produced at low cost. The rotation lever can engage with the support component for the adjustment of the same in any suitable way.

An extraordinarily advantageous improvement of the previously mentioned embodiment includes that the rotation lever is rotatably mounted to a pivot supported shaft, and with which the support component engages for the rotation of the same. This embodiment is simple in its construction, and is particularly robust so that especially high forces can be exerted with the furniture drive according to this embodiment.

A further improvement of the previously described embodiment includes that the rotation lever is positively connected to the shaft. This embodiment is particularly robust and suitable for the transmission of particularly high forces.

A further improvement of the embodiment having the rotation lever and the shaft includes that the shaft has a non-round cross section, and the shaft positively engages with a recess of the rotation lever, which recess is essentially formed complementary and corresponding to a cross section of the shaft. This embodiment is particularly simple in its construction.

According to another improvement, the recess of the rotation lever is constructed open in a radial direction of the shaft, whereby a locking means is provided for locking the shaft in the recess. This eases the insertion of the shaft into the recess.

A further improvement of the embodiment with the rotation lever includes that it is constructed as a two-armed lever, whereby each lever arm carries at least one turn roller. With this embodiment, a particularly compact construction can also be achieved.

The winding device can be constructed in any desired way. A particular improvement includes the winding device having a rotatable winding element attached to the end of the pull means opposite of the winding device, and that is rotatably mounted to a motor, such as an electric motor. Owing to the inventive use of the pulley principle, the motor, which forms the rotation drive for the winding element, can be small, and thereby at low cost.

An inventive piece of furniture used for sitting and/or laying upon equipped with an inventive support device is likewise achieved in accordance with the invention.

The invention is described in greater detail using the attached drawings, which illustrate an embodiment of an inventive support device in the form of a slat system.

Relative terms such as up, down, left, and right are for convenience only and are not intended to be limiting.

BRIEF DESCRIPTION OF THE DRAWINGS

The same, or corresponding, assembly components are identified by the same reference numbers in the drawings.

DETAILED DESCRIPTION OF THE INVENTION

Figure 1:
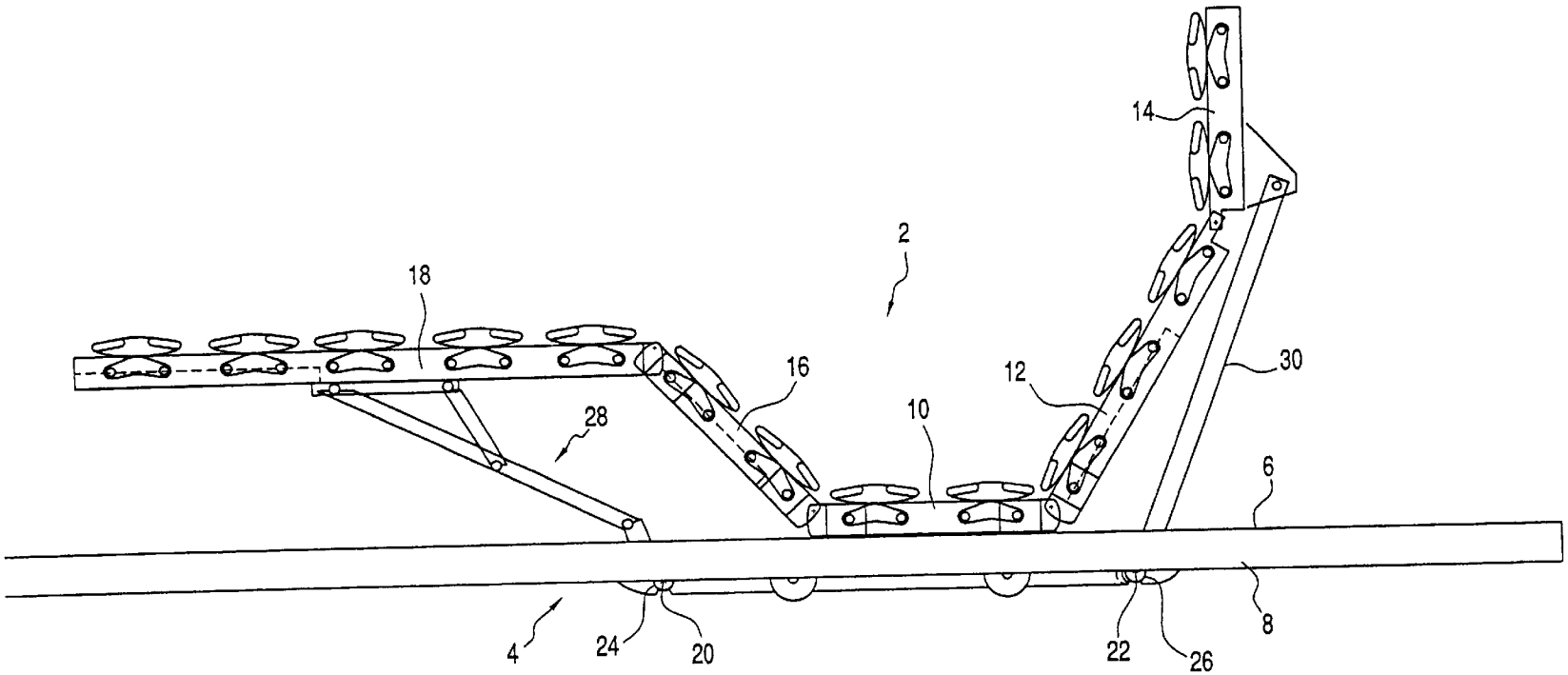
FIG. 1 illustrates a schematic side view of an embodiment of a support device according to the invention.

FIG. 1 shows an illustration of an embodiment of an inventive support device 2 that is constructed as a slat system in this embodiment, and that has a base body 4. The base body 4 has a frame 6 with longitudinal rails or frame members which are parallel to each other, of which only one longitudinal rail 8 is illustrated in the drawing, whereby the longitudinal rails 8 are connected to each other by means of cross laths.

The base body 4 further has several support components that can be adjusted in relation to one another, of which a center support component 10 is connected to the frame 6, and typically cannot be adjusted in relation to it. An upper body support component 12 is rotatably mounted about a horizontal pivot axis to the side of the center support component 10; and, at a side opposite of the center support component 10 a head or neck support component 14 is rotatably mounted about a horizontal pivot axis. A leg support component 16 is rotatably mounted to the side of the center support component 10 that is opposite of the upper body support component 12, and that can be rotated around a horizontal pivot axis. On a side opposite of the center support component 10 a lower leg support component 18 is rotatably mounted to the leg support component 16 which can be rotated around a horizontal pivot axis. The support device 2 serves for supporting the upholstery of a piece of furniture used for sitting and/or lying upon, such as the mattress of a bed, which is omitted from the drawing for clarity.

The inventive support device 2 is provided with a drive unit 32 detachably connected to the base body 4 for the adjustment of the support components 12, 14, 16, 18 in relation to the center support component 10 and to the frame 6, which drive unit 32 serves for the rotation of shafts 24, 26 connected to the frame 6 so that they rotate around rotation axes 20, 22.

The shaft 24 serves for the rotation of the lower leg support component 18 and for the leg support component 16 in relation to the center support component 10, and is connected to the lower leg support component 18 by means of a lever arrangement or linkage 28, while the shaft 26 serves for the adjustment of the upper body support component 12 and the head support component 14 in relation to the center support component 10, and is connected to the head support component 14 by means of a lever 30.

Figures 2, 5:
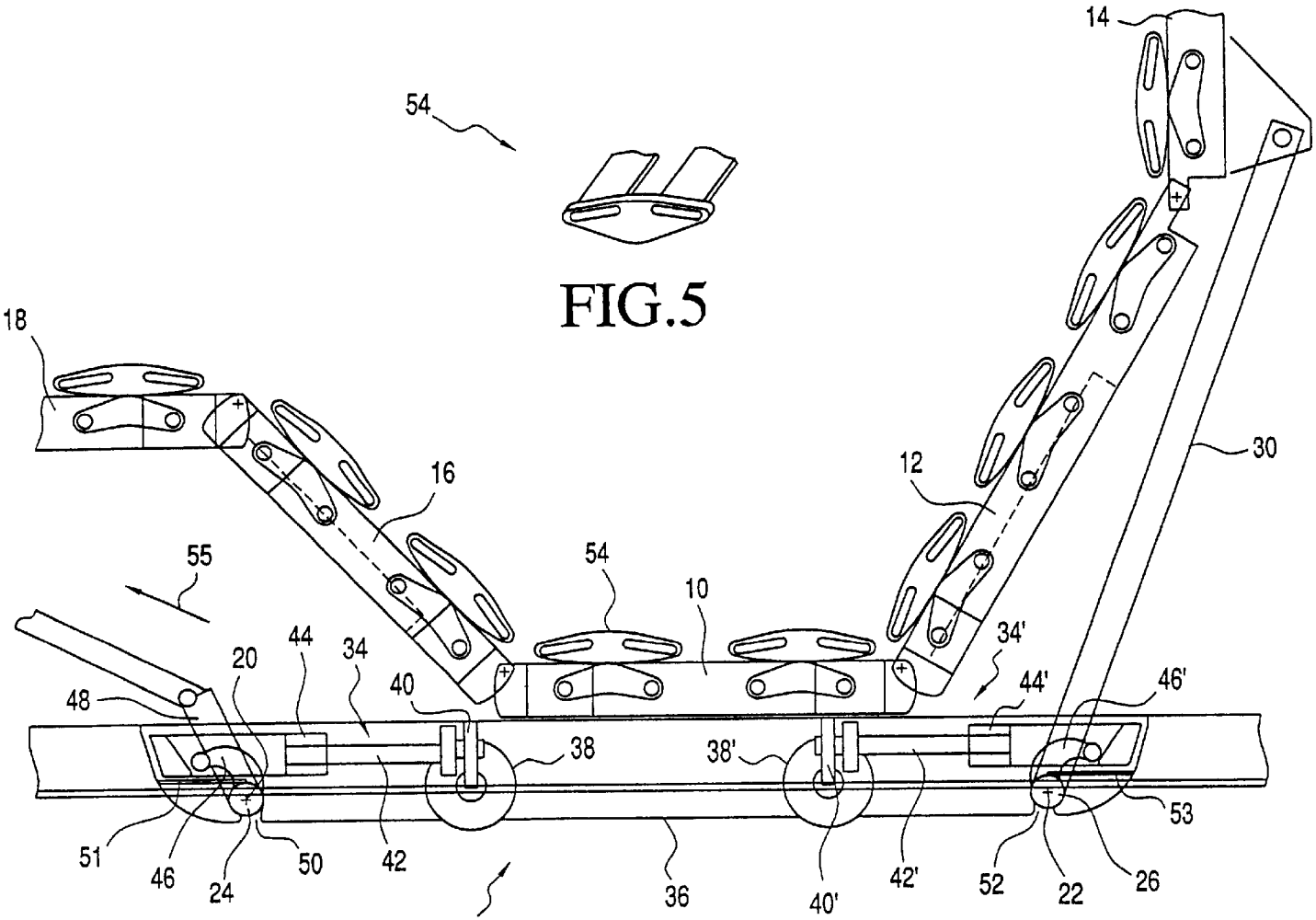
FIG. 2 illustrates an enlarged illustration of the support device according to FIG. 1 for purposes of clearly illustrating the arrangement of the drive unit on the base body of the support device, partially in phantom.
FIG. 5 illustrates a schematic perspective view of a portion of an inventive slat system.

FIG. 2 shows a drive unit 32 which is constructed as a double-drive, and which is mounted in this embodiment to the base body 4, which is provided with two drives 34, 34' received in a common housing 36.

The drive 34 is provided with an electric motor 38 that engages with a driven fixed spindle 42 by means of a gear drive 40, on which a spindle nut 44 is arranged nonrotatably and moveable in an axial direction, which forms a linearly movable drive element of the drive 34. The spindle nut 44 is constructed as an actuator or actuator element for a rotation lever 46 which is constructed as an angle lever in this embodiment and which is nonrotatably connected to the shaft 24.

For the adjustment of the lower leg support component 18 and of the leg support component 16 in relation to the center support component 10 from an (initial) base position into the adjustment or adjusted position illustrated in FIG. 1, the electric motor 38 drives the fixed spindle 42 in such a way that the spindle nut 44 is moved to the right in FIG. 2. It thereby rotates the rotation lever 46 in FIG. 2 in a clockwise direction so that the shaft 24 in FIG. 2 rotates in a clockwise direction, and hereby rotates the lever 48 which is nonrotatably connected to the shaft 24 of the lever arrangement 28 in FIG. 2 in a clockwise direction. Thus the leg support component 16 and the lower leg support component are adjusted in relation to the center support component 10 until the final position of the adjustment movement illustrated in FIG. 1 has been achieved.

The drive 34' is constructed corresponding to the drive 34, and is therefore not explained in detail; its assembly parts or components are identified by reference numbers which include the prime (') suffix and which correspond to the reference numbers of the assembly parts of the drive 34.

According to the invention, the drive unit 32 is placed onto the shafts 24, 26 from the support side, i.e., from the side of the base body 4 on which the support components 10, 12, 14, 16, 18 are arranged. In order to place the drive unit 32 onto the shafts 24, 26, the housing 36 is provided with recesses 50, 52, into which the shafts 24, 26 of the drive unit 32 engage in the assembly position illustrated in FIG. 2 so that the rotating levers 46, 46' connected to the shafts 24, 26 engage with the spindle nuts 44, 44' of the drive unit 32, as is shown in FIG. 2.

Owing to the fact that the drive unit 32 is placed onto the shafts 24, 26 from the support side, housing 36 of the drive unit 32 is received in a vertical direction between the support components 10, 12, 14, 16, 18, and the shafts 24, 26. As opposed to conventional support devices, the inventive support device 2 therefore has a substantially reduced height that is essentially determined by the height of the frame 6. The base body 4, together with the drive unit 32, has a height that is only insignificantly larger (e.g., higher) than the height of the base body 4 alone.

The assembly of the drive unit 32 on the base body 4 can, for instance, be performed before the center support component 10 is installed on the frame 6, or before the slats of the slat system, of which FIGS. 2 and 5 merely shows a pair of slats identified by the reference symbol 54, are connected to the center support component 10. However, it is also possible to install the drive unit to the base body 4 after the center support component 10 has been installed on the frame 6, and after the slats 54 have been mounted on the center support component 10. For this purpose, the drive unit 32 is initially pushed through between the center support component 10 and the shaft 24 laterally from the bottom in the direction of an arrow 55, and subsequently rotated in counterclockwise direction as viewed in FIG. 2, placed onto the shaft 26 with the recess 52, and finally rotated so that the shaft 24 engages with the recess 50. Locking means in the form of sliders 51, 53 may be provided for locking the drive unit 32 to the support device 2 in the assembly position illustrated in FIG. 2.

Figure 3:
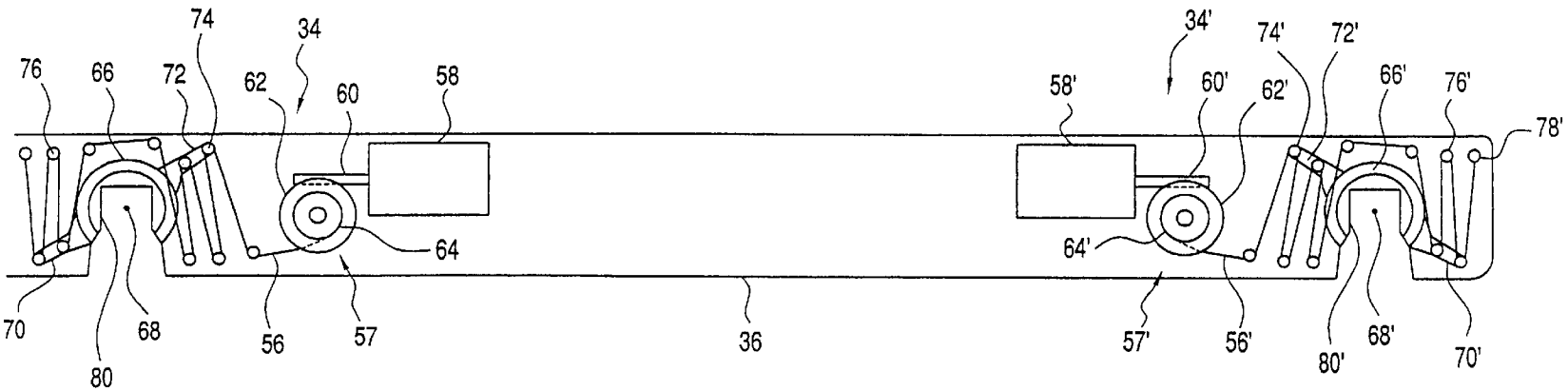
FIG. 3 illustrates an embodiment in schematic side view of an inventive furniture drive, whereby half of the housing has been omitted for purposes of illustration.

FIG. 3 shows an embodiment of an inventive furniture drive that is constructed as a double drive, and that has two drives 34, 34'. The following only explains the drive 34 in detail; the drive 34' is constructed correspondingly, and its assembly parts are identified by reference numbers that correspond to the reference numbers of the assembly parts of the drive 34, with the addition of a prime (') suffix; e.g., a drive 34' is analogous to drive 34, and so forth.

The drive 34 is provided with a winding device 57 for a flexible pull means or pulling element in the form of a thin rope 56, and has a compact electric motor 58, the drive shaft of which drives a worm 60 which engages with a worm gear 62.

A rotatably connected winding element 64 is nonrotatably connected with a worm gear 62 and serves for the winding of the rope 56, the end of which that faces the winding device 54 is fixed on the winding element 64.

The drive 34 additionally has a rotation lever 66 rotatably connected around a rotation axis 68, which extends into the drawing as viewed in FIG. 3. The lever is constructed as a two-armed lever in this embodiment, the arms 70, 72 of which carry turn rollers for the rope 56, of which only one turn roller is identified by the reference symbol 74 in FIG. 3.

The rope 56, according to the principle of a multiple rope or multi-pulley system, is successively fed across the turn rollers 74 of the rotation lever 66 and across turn rollers that are connected to the interior walls of the housing 36, of which only one turn roller is identified by the reference number 76 in FIG. 3. An end 78 opposite to the winding device 57 of the rope 56 is fixed on an interior wall of the housing 36.

The rotation lever 66 can be connected to a shaft that is not illustrated in FIG. 3 in the assembly position of the furniture drive, and which engages with the support component to be adjusted. In the embodiment according to FIG. 3, the nonrotatable connection between the rotation lever 66 and the shaft not illustrated in FIG. 3 is a positive-fit connection. For this purpose the rotation lever 66 has a recess 80 with an out-of-round cross section, whereby the cross section of the shaft is constructed substantially complimentary to the cross section of the recess 80, and the shaft engages positively with the recess 80 in the assembly position.

Figure 4:
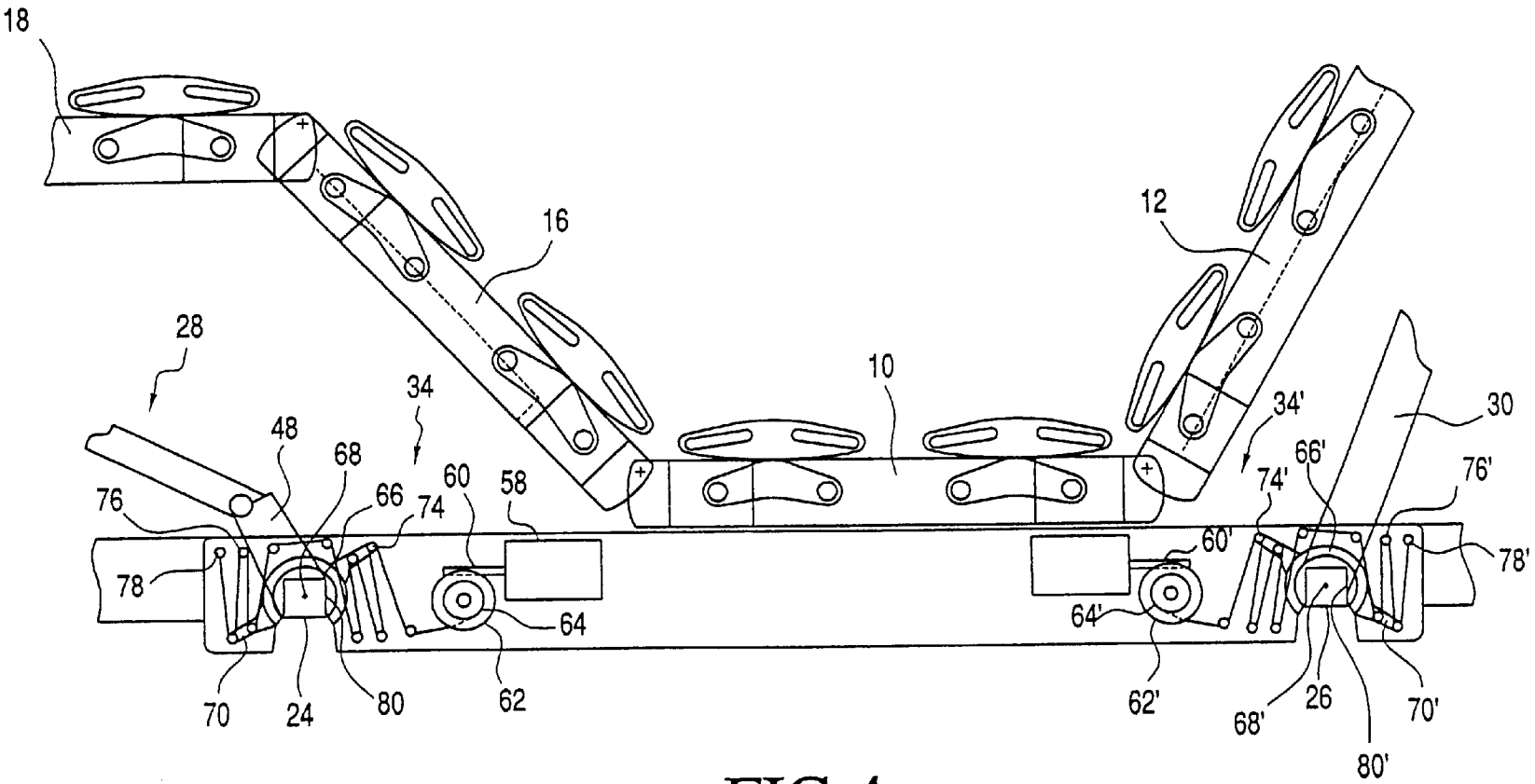
FIG. 4 illustrates an inventive support device similar to FIG. 1 with the furniture drive according to FIG. 3 illustrated in the same manner as FIG. 2.

FIG. 4 shows the furniture drive according to FIG. 3 in the assembly position, in which the drive unit 32 is placed onto the shafts 24, 26 from the support side. As FIG. 4 shows, the cross section of the shafts 24, 26 is constructed essentially complementary to the cross section of the recesses 80, 80' of the rotation levers 66, 66' of the drive unit 32 so that in the assembly position of the drive unit 32 the shaft 24 is nonrotatably connected to the rotation lever 66, and the shaft 26 is nonrotatably connected to the rotation lever 66'.

In order to maintain the shafts 24, 26 in the recesses 80, 80' which are open toward the radial directions, locking means may be provided that are not illustrated in the drawing.

The operation of the inventive furniture drive is as follows.

The electric motor 58 drives the winding device 57 for the adjustment of the lower leg support component 18 and the leg support component 16 in relation to the center support component 10 in such a way that the winding element 64 in FIG. 4 rotates in a counter-clockwise direction so that the rope 56 is wound up. Because of this the shaft 24 in FIG. 4 rotates in a clockwise direction so that the leg support component 16 is rotated into the adjustment position illustrated in FIG. 4 by means of the lever arrangement or linkage 28, the lever 48 of which is nonrotatably connected to the shaft 24.

Correspondingly, the upper body support component 12 and the neck or head support component 14 can be adjusted by means of the drive 34'. The reversal (i.e., returning) of the support components into the base or initial position, in which the support components 10–18 span a mutual horizontal support level, occurs thanks to the force of the weight of the support components, but at engaged drive.

Due to the use of the pulley principle, for example, high forces can be exerted by the inventive furniture drive so that the motor 58 can be small and compact. The inventive furniture drive can be used both in the inventive support devices, in which it is placed onto the shafts 24, 26 from the support side, and by such support devices in which it is placed onto the shafts 24, 26 from the side opposite of the support side, or in which the furniture drive is slid onto the shafts 24, 26 in an axial direction. The inventive furniture drive can therefore be used with/in any desired support devices independently of the type of assembly. It can be constructed as a double drive with two drives which are received in a housing, as is the case in the embodiment according to FIG. 3. However, the drive according to the invention can also be constructed as a single device with a single drive, or the inventive drive may have any number of drives.

FIG. 5 shows slats or slat system 54 described above in connection with FIG. 2.

Figure 6:
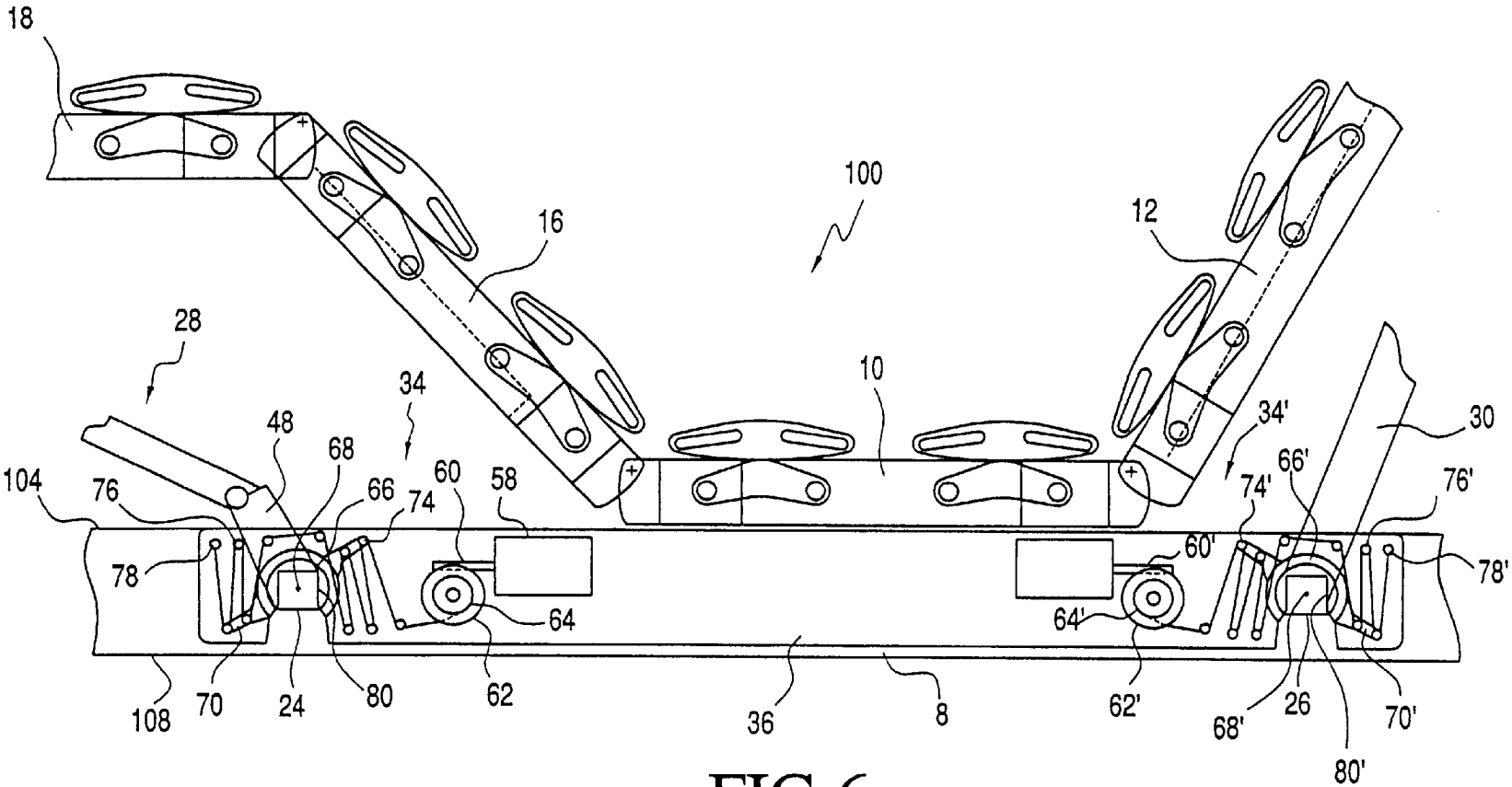
FIG. 6 illustrates an inventive support device similar to FIG. 4.

FIG. 6 shows an embodiment of an inventive support device 100, similar to the embodiment of FIG. 4.

Support device 100 includes housing 36 disposed completely within, or substantially completely within, planes such as the illustrated horizontal planes, which planes are respectively defined by an upper surface 104 and a lower surface 108 of rail or frame member 8.

As is readily apparent, housing 36 and the components of the drive unit contain therein are contained completely within the horizontal planes 104, 108.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Motor adjustable support device for a piece of reclining furniture, comprising:

a) a base;

b) at least two support components provided on the base and defining a support side of the support device, the at least two support components being adjustable relative to each other;

c) at least one detachable drive unit detachably connected to the base;

d) a drive housing provided for the at least one drive unit;

e) at least one recess provided in the drive housing;

f) a rotatable shaft provided for adjusting the at least two support components relative to each other;

g) at least one of the rotatable shaft and a drive of the at least one drive unit extending through the at least one recess for engaging with the other one of the at least one rotatable shaft and the drive of the at least one drive unit;

h) the at least one detachable drive unit being provided in the drive housing for causing the drive to engage the rotatable shaft by placing the drive unit onto the at least one shaft from the support side, the at least one drive unit thereby adjusting the at least two support components relative to each other when the at least one drive unit is driven; and i) the at least one drive unit being disposed substantially between the at least two support components and the rotatable shaft.

2. Support device as in claim 1, wherein:

a) the rotatable shaft is connected to the base.

3. Support device as in claim 2, wherein:

a) a rotation lever is nonrotatably connected to the rotatable shaft, and the rotatable shaft is rotatably connected for the rotation thereof to a drive motor of the at least one drive unit.

4. Support device as in claim 3, wherein:

a) the at least one drive unit includes at least one linearly movable drive element, with which drive element the rotation lever is rotatably connected for the rotation thereof.

5. Support device as in claim 3, wherein:

a) the rotation lever is one of an angled and a bent lever.

6. Support device as in claim 4, wherein:

a) the linearly movable drive element includes a nonrotatable spindle nut, and the spindle nut is attached movably in an axial direction on a driven fixed spindle.

7. Support device as in claim 4, wherein:

a) the at least one linearly movable drive element includes a fixed spindle movable in an axial direction, and on which a locally fixed, driven spindle nut is arranged.

8. Support device as in claim 1, wherein:

a) a locking element is provided for the locking of the at least one detachable drive unit to a portion of the support device.

9. Support device as in claim 1, wherein:

a) the rotatable shaft includes two rotatable shafts;

b) the at least one recess includes two recesses; and c) each of the two recesses is associated with a respective one of the two rotatable shafts.

10. Support device as in claim 1, wherein:

a) the base includes a frame.

11. Support device as in claim 1, wherein:

a) a slat system is provided.

12. Support device as in claim 1, wherein:

a) the at least one drive unit includes a winding device for winding a strand-like pulling element;

b) one end of the strand-like pulling element is connected to the winding device;

c) the strand-like pulling element is fed across at least one first pulley-like turn roller, said at least one first pulley-like turn roller being connected to a part which is fixed during adjustment of at least one of the at least two support components;

d) said strand-like pulley element is fed across at least one second pulley-like turn roller which is connected to one of the two support components; and e) said strand-like pulley element cooperates with said first and second pulley-like turn rollers to define a pulley-block.

13. Support device as in claim 1, wherein:

a) said first and second pulley-like turn rollers define an at least 4-pulley system.

14. Support device as in claim 13, wherein:

a) a plurality of turn rollers is assigned to a drive, and is arranged on one of the housing and on another locally fixed part during the adjustment of the at least two support components, and the plurality of turn rollers has one of coaxial pivot axes and a mutual pivot axis.

15. Support device as in claim 13, wherein:

a) a plurality of turn rollers is assigned to the at least two support components, and the plurality of turn rollers is arranged on one of the at least two support components and on an intermediate part, and the plurality of turn rollers has one of coaxial pivot axes, and a mutual pivot axis.

16. Support device as in claim 13, wherein:

a) a plurality of turn rollers has pivot axes parallel to each other and is assigned to a drive, and the plurality of turn rollers is arranged on one of the housing and on another locally fixed part during the adjustment of the one of the two support components.

17. Support device as in claim 13, wherein:

a) a plurality of turn rollers which has pivot axes parallel to each other is assigned to the one of the two support components, and the plurality of turn rollers is arranged on one of the two support components and on an intermediate part.

18. Support device as in claim 12, wherein:

a) an end of the strand-like pulling element opposite of the winding device is fixed on one of the two support components to be adjusted.

19. Support device as in claim 12, wherein:

a) an end of the pulling element opposite of the winding device is fixed on an intermediate part which engages with one of the two support components for the adjustment thereof.

20. Support device as in claim 12, wherein:

a) an end of the pulling element opposite of the winding device is fixed on one of the housing and a first part of a piece of reclining furniture to which the housing is connected.

21. Support device as in claim 12, wherein:

a) the at least one drive unit includes a rotation drive for the rotation of one of the two support components in relation to a first part.

22. Support device as in claim 12, wherein:

a) a rotation lever is provided, and the rotation lever carries the at least one turn roller.

23. Support device as in claim 22, wherein:

a) the rotation lever is nonrotatably connected with the rotatable shaft, with which one of the two support components engages for the rotation thereof.

24. Support device as in claim 23, wherein:

a) the rotation lever is nonrotatably connected to the rotatable shaft by a positive fit provided therebetween.

25. Support device as in claim 24, wherein:

a) the positive fit includes a nonround cross section of the rotatable shaft, and the nonround cross section positively engages with a recess of the rotation lever.

26. Support device as in claim 25, wherein:

a) the recess of the rotation lever is open in a radial direction of the rotatable shaft; and b) a locking element is provided for locking the rotatable shaft in the recess.

27. Support device as in claim 22, wherein:

a) the rotation lever includes a two-armed lever, and each lever arm of the two-armed lever carries at least one turn roller.

28. Support device as in claim 12, wherein:

a) said strand-like pulling element is connected to an intermediate part operatively connected to one of the at least two support components.

29. Support device as in claim 1, wherein:

a) a winding unit including a rotatably connected winding element is provided;

b) a pulling element is provided;

c) an end of the pulling element facing the winding unit is attached to the winding element; and d) the at least one drive unit includes an electric motor to which another end of the pulling element is attached.

30. A piece of furniture for one of sitting and laying upon, comprising:

a) motor adjustable support device for a piece of reclining furniture, comprising:

i) a base;

ii) at least two support components provided on the base, the at least two support components defining a support side of the support device and being adjustable relative to each other;

iii) at least one detachable drive unit detachably connected to the base;

iv) a drive housing provided for the at least one drive unit;

v) at least one recess provided in the drive housing;

vi) a rotatable shaft provided for adjusting the at least two support components relative to each other;

vii) at least one of the rotatable shaft and a drive of the at least one drive unit extending through the at least one recess for engaging with the other one of the at least one rotatable shaft and the drive of the at least one drive unit, the at least one drive unit thereby adjusting the at least two support components relative to each other when the at least one drive unit is driven;

viii) the at least one detachable drive unit being provided in the drive housing for engaging the drive with the rotatable shaft by inserting the at least one drive unit from the support side of the support device, the at least one drive unit thereby adjusting the at least two support components; and ix) the at least one drive unit being disposed substantially between the at least two support components and the rotatable shaft.

31. Piece of furniture as in claim 30, wherein:

a) the support device includes a slat system.

32. A furniture drive for a support device of a piece of furniture of the type having at least two relatively adjustable support components for one of sitting or laying upon, the at least two support components defining a support side of the support device comprising:

a) at least one detachable drive unit detachably connectable to a piece of furniture;

b) a drive housing provided for the at least one drive unit;

c) at least one recess provided in the drive housing;

d) the at least one drive unit being engageable with a rotatable shaft of a piece of furniture for adjusting the at least two support components relative to each other;

e) at least one of a rotatable shaft of a piece of furniture and a drive of the at least one drive unit extending through the at least one recess for engaging with the other one of the at least one rotatable shaft and a drive of the at least one drive unit, in use;

f) the at least one detachable drive unit being provided in the drive housing for causing the drive to engage a rotatable shaft of a piece of furniture by inserting the at least one detachable drive unit from the support side of the support device on which at least two support components of a piece of furniture are provided in use, the at least one drive unit thereby adjusting the at least two support components relative to each other when the at least one drive unit is driven, in use; and g) the at least one drive unit being disposed substantially between the at least two support components of a piece of furniture and the rotatable shaft, in use.

33. Furniture drive as in claim 32, wherein:

a) the at least one drive unit includes a winding device for winding a strand-like pulling element;

b) a strand-like pulling element is connected at one end to the winding device and at another end the strand-like pulling element is connectable to one of the at least two support components of a piece of furniture for adjusting the at least two adjustable support components relative to each other when the winding device is wound, in use; and c) the strand-like pulling element is one of: fed across at least one pulley-like turn roller, fed on a part fixed relative to another part during adjustment of the at least two support components, fed of the at least two support components, fed across at least one turn roller provided on one of the at least two adjustable support components, and fed on at least one turn roller provided on an intermediate component of a piece of furniture, in use.

* * * * *